US006170573B1

(12) United States Patent
Brunet et al.

(10) Patent No.: US 6,170,573 B1
(45) Date of Patent: Jan. 9, 2001

(54) FREELY MOVING OIL FIELD ASSEMBLY FOR DATA GATHERING AND OR PRODUCING AN OIL WELL

(76) Inventors: Charles G. Brunet, 2115 Argonne, Apt #6, Houston, TX (US) 77019; Michel J. Bouchard, 3131 W. Alabama, Suite 211, Houston, TX (US) 77098

( * ) Notice: Under 35 U.S.C. 154(b), the term of this patent shall be extended for 0 days.

(21) Appl. No.: 09/116,046

(22) Filed: Jul. 15, 1998

(51) Int. Cl.[7] ..... E21B 23/00; E21B 23/10

(52) U.S. Cl. ..... 166/153; 166/70; 166/156; 166/250.01; 166/372; 417/56

(58) Field of Search ..... 166/250.01, 250.04, 166/70, 113, 153, 156, 250.015, 372; 417/56, 57, 58, 60

(56) References Cited

U.S. PATENT DOCUMENTS

| | | | | |
|---|---|---|---|---|
| 2,555,112 | * | 5/1951 | Brown | 417/59 |
| 3,076,509 | * | 2/1963 | Burns et al. | 166/70 |
| 3,731,742 | * | 5/1973 | Sizer et al. | 166/315 |
| 3,796,883 | * | 3/1974 | Smith et al. | 250/260 |
| 3,965,978 | * | 6/1976 | Conley et al. | 166/113 |
| 4,070,134 | * | 1/1978 | Gramling | 417/56 |
| 4,150,721 | * | 4/1979 | Norwood | 166/53 |
| 4,211,279 | | 7/1980 | Isaacks . | |
| 4,274,486 | * | 6/1981 | Fredd | 166/250 |
| 4,636,934 | * | 1/1987 | Schwendemann et al. | 364/132 |
| 4,685,522 | * | 8/1987 | Dixon et al. | 166/372 |
| 4,712,981 | * | 12/1987 | Gramling | 417/56 |
| 4,806,928 | * | 2/1989 | Veneruso | 340/856 |
| 4,986,727 | | 1/1991 | Blanton . | |
| 4,989,671 | * | 2/1991 | Lamp | 166/53 |
| 5,008,664 | | 4/1991 | More et al. . | |
| 5,095,983 | * | 3/1992 | Magnani | 166/250 |
| 5,132,904 | | 7/1992 | Isaacks . | |
| 5,253,713 | * | 10/1993 | Gregg et al. | 166/372 |
| 5,462,115 | | 10/1995 | Belden et al. . | |
| 5,501,272 | * | 3/1996 | Coutts et al. | 166/250.01 |
| 5,967,231 | * | 10/1999 | Laurel et al. | 166/250.04 |
| 5,987,385 | * | 11/1999 | Varsamis et al. | 702/6 |

* cited by examiner

*Primary Examiner*—Eileen D. Lillis
*Assistant Examiner*—Jong-Sak Lee
(74) *Attorney, Agent, or Firm*—Parks and Associates P.C.

(57) ABSTRACT

An oil field assembly for gathering data about or producing an oil well having a self regulating assembly for free movement by gravity or the differential pressure of fluids in the tubing string of a well from the surface of a well or to predetermined down hole positions for collecting data and or producing a well while freely moving between the surface of the well and predetermined positions comprising a self regulating traveling piston for free movement by gravity and or the differential pressure of the fluids of a well from the surface of a well and to predetermined positions for collecting data about a well between the surface and predetermined downhole positions, and having instrumentation connected to the traveling piston for gathering data about the well, and a landing housing located at the surface of a well for receiving the traveling piston, and a receiving station at the bottom of the tubing string for releasably receiving the traveling piston.

28 Claims, 9 Drawing Sheets

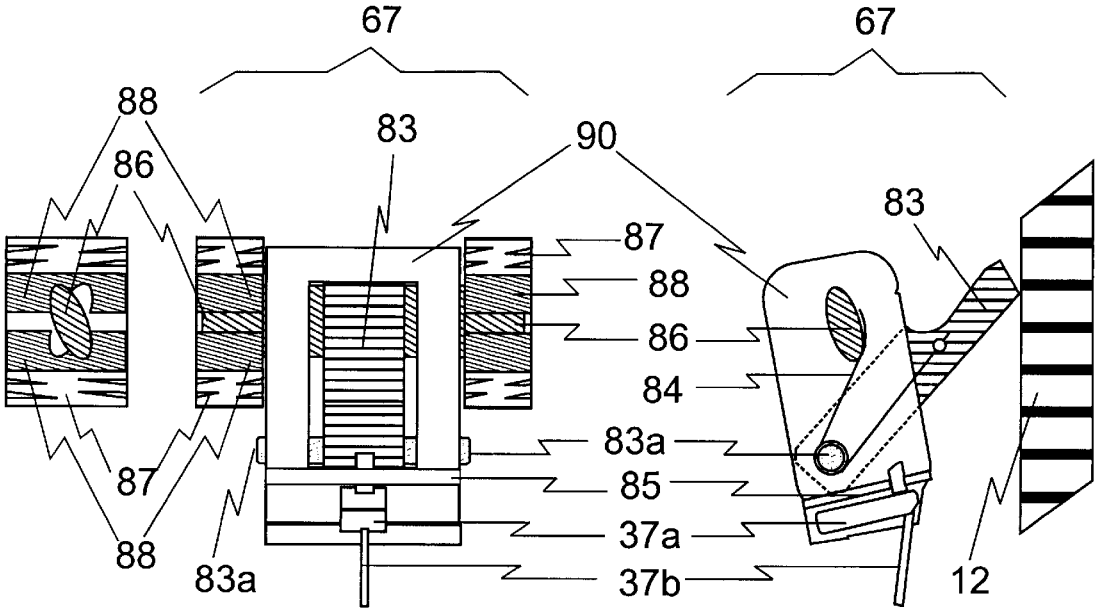
FIGURE 12 FIGURE 11 FIGURE 9
FIGURE 12b
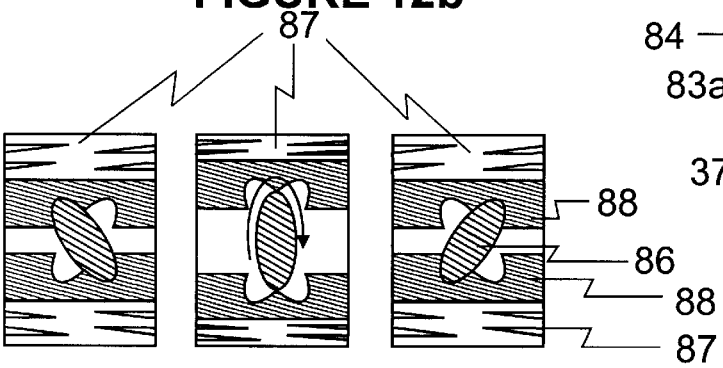
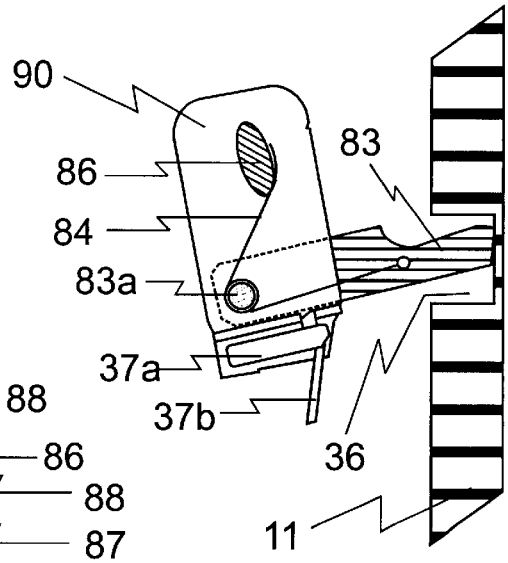
FIGURE 12A FIGURE 12C FIGURE 10

FREELY MOVING OIL FIELD ASSEMBLY FOR DATA GATHERING AND OR PRODUCING AN OIL WELL

SUMMARY OF INVENTION

This invention relates to an oil field assembly for gathering data about and/or producing an oil well using a self regulating, freely traveling piston located in the tubing string of a well located in a well casing which is moved solely by gravity and or the differential pressure of the fluids in a well from or to the surface of a well or from or to predetermined downhole positions or a position and for collecting of data while freely moving between the surface of the well and the down hole positions and for producing the well in its return to the surface of the well using a self regulating, traveling piston with free movement solely by gravity and or the differential pressure of the fluids of a well with instrumentation located thereon for gathering data about the well while controlling the traveling piston's speed of free movement and having a landing housing at the surface of a well and a landing receiving station at a predetermined down tubing string position and instrumentation at the landing housing for downloading the data gathered by the instrumentation on the self regulating, travelling piston when the traveling piston returns to the surface and or produces the well in the process of the return of the traveling piston to the surface.

BACKGROUND OF THE INVENTION

The prior art to date has relied on two separate technologies and markets for well surveying and plunger lift production. The plunger lift production technologies used pigs or swabs for servicing wells to keep them in production. Thus in the plunger lift technologies for oil wells the industry relied upon technologies which are relatively primitive because they relied on hard and durable plungers with preset mechanical adjustments which would be set on these devices for the presumed conditions in a well before they were inserted into the well. Thus the operators of a well did not have to worry about the impact speeds and forces on the pigs or swabs when they struck the bottom of the hole because they were just hard material with no "soft" electrical instruments on board. The well surveying technologies have been developed in a different way using electronic instruments to collect the data about downhole conditions in a well. These electronic instruments had to be lowered into a well and retrieved from a well on a wire line to protect the instruments from damage and to allow the correlation of vertical position in the well relative to the data gathered. Thus to date each of these industries developed distinct technology for their markets in the oil field business but this bifurcated development lead to the limitations of the technology for use outside of their respective field of application.

Thus for example in the past, if a well operator needed oil well surveying data, such as pressures, temperatures, etc, through out the tubing string, they would call out a wire line service company and the service company would take readings on a well, using instruments mounted on a structural cable which was lowered into the well. These cables operations came in the form of slickline and or conductor line services with very large reels of cable and required significant amounts of equipment be mounted over the hole of the well to conduct this operation.

In this wire line process a large reel of wire with sufficient strength to support both the wire and the data gathering device while they are lowered into the hole and retrieved was positioned over the well at the surface. In fact it was a major operation forjust the coiling and uncoiling of the bulky structural wire line on which the data gathering device was run into the hole. Also as part of the process a grease cap was used to keep the well sealed as the cable was being moved either up or down the tubing in the process of running the wire line. The grease caps as those skilled in this art know are messy and can be difficult at their best operating conditions to use. The wire line process was a very expensive and cumbersome operation which in some cases took the well out of production while the process was being conducted. Further these wire line service processes required constant attention and thus it also took two to three people to operate such a system. The bulky reels were used because the cable rolled upon the reels had to be long enough to go to the bottom of the well and had to be large and strong enough to support the lowered device and the weight of the cable when they are lowered into the well. Also, these well surveying operations took time to set up and take down in addition to the time for acquiring the data. Further, these companies' services were very expensive because the equipment they use is very expensive and it required several skilled people to operate at the well site. Also because of the complex nature of these wire line service processes, which required constant attention, they could not be done remotely or in an automated manner from a remote site.

Also in the prior art it was well know to set a semi-permanent type data gathering device in a well, usually in a side pocket mandrel where the sensor assembly can be communicated with from time to time by lowering a line with some type of inductive device which allows downloading of the data accumulated by the sensor assembly without the need to transport the data gathering assembly to the surface except for repair or battery replacement. Once the data is downloaded to the inductive device then the device and line are then removed and the data read on the surface. The problem with this approach is that an expensive sensor assembly was left in the hole and it can not be moved from well to well on demand without a great deal of effort and the running of a tool to recover the device. Also in this semi-permanent type of prior art device if the well is not just being completed or drilled it required the pulling of the tubing string which requires a work over rig to pull the tubing and then put it back in the well with the data gathering device attached, which is a very expensive process. Further, there is still the need to run the wire line through the grease cap when it becomes time to get the data from the semi-permanent type well data gathering sensor assembly with all of the problems associated there with.

Also known in the prior art is an another semi-permanent type of data gathering device which is dropped off in the well and connected to a surface data acquisition device by a conductor line. These systems can be communicated with remotely and the data can be downloaded on a per demand basis. The problem with this prior art was that it still required the lowering of a line through a grease cap and the intrusion into the well of a wire line to communicate with the data gathering device on the bottom of the hole and the problems associated therewith. A further disadvantage of this prior art is that it required the expansive conductor line to remain on the site for the duration of the measurement period increasing significantly the cost of the operation.

Also in the prior art it was well know to set a permanent type data gathering device in a well, usually in a side pocket mandrel where the sensor are connected to a cable which is attached to the outside of the tubing. This method requires the use of a workover rig to pull out and reinsert the tubing in the well. This method permits continuous monitoring of data from the bottom of the well but is very expensive due the need from the well operator to purchase the cable and the measuring device and the high cost associated with the tubing manipulation for the installation and maintenance of the measuring device.

The most recent prior art involves data gathering devices which are inserted in the well either on wireline or on the end of the tubing string using a workover rig as described in the above previous arts but this prior art differentiates by the way it communicates its accumulated data to the surface through the use of Electro-magnetic waves. Again the main disadvantage is the costs associated with wireline and or workover rig operations necessary to install and or maintain these data gathering devices.

In the plunger prior art if well operators needed to produce a well, they would resort to using a plunger lift system which acts like a large lifting piston to bring production liquids to the surface. Once the liquids were brought to the surface the lifting piston was dropped back into the well for another production stroke. The lifting piston was effectively a free fall piston, which took great forces of impact upon landing in the bottom of the well. Also these plunger lift systems generally relied upon the well being able to generate sufficient pressure to drive the lifting piston up the well and push the column of production liquids and or water out of the well before another stroke of the piston could occur. Thus wells which had too low a pressure in them could not even be produced using this method.

The prior art also used plunger lift systems to improve some wells production by having a plunger freely travel from a surface catcher to a landing assembly attached inside the production tubing string close to the well's productive zone. The plunger traveled down the well using only gravity and was sent back up to the surface driven solely by the wells fluids and pressure based on a preset standard from assumed operating assumptions about the well, thus there was no real time ability to adjust the plunger in real time for the real and changing conditions of a well. A further problem with such plunger lift systems was that they hit the downhole receiving assembly and the surface landing housing with such force that if any instruments used to gather data about a well had been attached to the plunger they would have been destroyed on impact.

Another problem with the prior art plungers was the danger of running a plunger dry to the surface on its return from the bottom of the well. In the prior art there was no way to adjust the plunger if dry hole conditions occurred and the problem with that was that the plunger upon its return to the surface of the well would be traveling at excessive speed and would do damage to the housing into which it was received or do damage to the plunger itself. Clearly if it was carrying instrumentation of any kind the instrumentation could be destroyed.

If well operators needed to produce a well, they would also resort to using a non intelligent plunger lift system which acts like a large lifting piston to bring production liquids to the surface and was controlled from the top side of the well on the surface by controlling the well flow. Once the liquids were brought to the surface the lifting piston was dropped back into the well for free fall back into place for another production stroke. The prior art lifting piston was effectively a free fall piston, which like other plunger systems, took great forces of impact upon landing in the bottom of the well. Also these plunger lift system generally relied upon the well being able to generate sufficient pressure to drive the lifting piston up the well and push the column of production liquids out of the well before another stroke of the piston could occur. Thus wells which had too low a pressure in them could not even be produced using this method because the lift plunger would be stuck down hole and had to be fished for and then removed from the well once caught. In any event this was at great cost and inconvenience for the operator.

In the case of plunger lift operations most of the plungers were mechanically controlled and the controls were set before they were put into the well based on the operating criteria of the particular well. If the well deviated the plunger could on one hand stick or hang in the well because it did not have sufficient velocity to make it back to the surface or in other cases the plunger could come up so fast and hard, because of excessive pressures in the well, that damage could occur at the surface upon the return of the plunger to the surface.

Also in the prior art of plunger lifts, there was used automatic production using fixed time cycles. These fixed timed cycles were used to produce a well by dropping the plunger back into the well based on the assumed time cycle which should be right for the well, but it was based merely on time and there was no way to know if it was maximizing the production cycle in response to the conditions in the well.

Also in the prior art of plunger lifts, there was programmable surface controller with pressure and flow sensors which would regulate the plunger cycles by controlling the flow of the well trough the opening and closing of surface valves in response to their sensors reading and time between cycles. The problem with these plunger systems was that they only had the surface conditions of the well to base their decisions upon and did not know of the real time downhole conditions that their plunger was submitted to and therefore their regulating actions were delayed reaction based on "past" downhole conditions. The ones skilled in the art of plunger lift will appreciate that the lack of knowledge about the real time downhole conditions such as pressure and temperature and instantaneous speed of the plunger is a detriment to plunger cycling optimization.

In some cases the plunger technologies used U-tubes to produce the lifting forces such that the plunger was pushed by pressurized gas up one leg of the U-tubes or the other. These U-tubes required larger well bores be drilled to accommodate the two tubes which form the U-tubes. Further having to use two tubes was very expensive and can be difficult and time consuming to install.

The prior art, thus, required a specialized tool and running operation for data gathering and a specialized tool for use as a plunger lift. Therefore the prior art technology required a special run by each technology into the well bore to perform it's job and as those in the well art know each run into a well greatly increases the costs of operating a well.

Finally the prior art whether of data gathering or plunger type systems were relatively expensive in equipment and man power costs and required multiple trips into the well.

OBJECTS OF THE INVENTION

It is the object of this invention to convey data gathering devices up and down a well using only gravity and the differential pressure of the fluids in the well thus eliminating the need for wire lines and/or manipulation of the tubing string to lower and retrieve these data gathering devices in and from the well.

It is the further object of this invention to gather data by having the data gathering device come up to the surface riding or driven by the fluids of the well and with out the necessity to run a data gathering line down to the data gathering device and then allow the down loading of the information gathered about the well at the surface.

Yet another object of this invention is to provide a piston to carry the data gathering instrumentation to the bottom of the hole and to control the high acceleration or speed of the piston on the way to the bottom of the hole so that the instrumentation would not be destroyed by the impact of the landing of the piston when it hits the bottom of the hole.

Also another object of this invention is to provide a piston to carry the data gathering instrumentation to the surface of the hole and to control the high acceleration or speed of the piston on the way to the surface of the hole so that the instrumentation would not be destroyed by the impact of hitting the landing housing when it is returned to the surface.

One object of this invention is to provide an assembly which does not require a special separate run into a well to either gather data and another separate run into a well to produce the well but provides an assembly which uses the same device to do both and to allow the collection of data at any time and all along the path of the tubing string as well as at the bottom thereof.

A further object of this invention is to provide a data gathering and/or production assembly which can operate automatically with few or no personnel present at the site and in some cases, were computer and telecommunication equipment is installed, it can be operated remotely by computer from great distances away from the well.

It is also an object of this invention to provide controlled descent into the well bore to allow the recording of the data during the descent and or during the ascent of the data gathering device into or up from the well bore trip as well as to prevent damage to the data gathering devices mounted to the traveling piston of this invention.

Also it is an object of this invention to provide a means to obtain well data and produce a well at the same time using the well data obtained to maximize the production of the well in real time and not to rely only on prior data obtained by the prior wire line service data and/or on the data acquired from surface sensors.

It is also an object of this invention to utilize the conventional configuration and well equipment already in use in existing wells with the oil field assembly of this invention, such that the self regulating, freely movable assembly can utilize and operate with existing "Landing Nipple" assembles in current wells for example.

A further object of this invention is to provide a self regulating freely moving assembly which can use the existing well equipment and remain down hole for sustained periods of time when long term data gathering is desired or required about a well and then provide a positive mechanical signal to the assembly down hole to return to the surface without having to fish, run wire lines or manipulate the tubing string to retrieve the down hole assembly to the surface.

A further object of this invention is to provide a self regulating freely moving assembly which can use the existing well equipment and remain down hole for sustained periods of time when long term data gathering is desired or required about a well and then using data from its instrumentation payload and in accordance with preprogrammed instructions self-initiate its return to the surface by modifying its cross sectional area without having to fish, run wire lines or manipulate the tubing string to retrieve the down hole assembly to the surface.

It is also an object of this invention to provide a production tool which can be adjusted in real time based upon the data the tool is obtaining as it collects the data such that the production tool becomes intelligent and interactive.

It is also an object of this invention to improve the data gathering process by making adjustments to speed and rate of ascent and descent and to the instruments sampling rate to match the descent or ascent rates in real time basis for obtaining the maximum amount of useful readable data about a well.

Also an object of this invention is to provide an intelligent production system and data gathering system which can work together and not require two separate instruments or require two separate operations to achieve the combined results of both.

A further object of this invention is to provide a well data gathering assembly and well production device in a combined form which can be intelligent and operate automatically with a limited number of personnel and with the personnel being located remotely from the well.

A beneficial object of this invention is to eliminate the need for bulky reels, cables, and other expensive equipment used by wire line operations and/or expensive tubing string manipulation operations to obtain well data about a well and to obtain the data without interfering with the production of the well during the data gathering operations.

It is an object of this invention to add one section of tubing string with a one way check valve, if such does not exist in an existing old well, for the injection of high pressure fluids from the annulus between the tubing string and the casing to provide fluid pressure to drive the self regulating assembly in a production operation if the well's own fluids or pressures are insufficient to drive the assembly up the tubing string in production operations.

Still other advantages and benefits of the invention will become apparent to those skilled in the art upon a reading and understanding of the following detailed description.

BRIEF DESCRIPTION OF THE DRAWINGS

This invention may be practiced in certain physical forms and arrangements of the parts herein described, but a few preferred embodiments of which will be described in detail in the specification and illustrated in the accompanying drawings, which form a part hereof.

FIG. 9 is a cross sectional diagrammatic view of the releasable latching member as the traveling piston travels down the tubing string and just before moving outwardly from the traveling piston to lock the traveling piston in a predetermined down hole position.

FIG. 10 is a cross sectional diagrammatic view of the releasable latching member in a predetermine down hole position with the releasable latching member in one locking position.

FIG. 11 is front representational view of one of the releasable latching members.

FIG. 12 is side representational view of one of at least two positioning cam surfaces, springs for holding the cam surfaces, and at least one cam connected to an axle of the latching member.

FIG. 12A is a side representational view of one position of the at least two positions of the cam surface.

FIG. 12B is a side representational view of an in between position of the at least two positions of the cam surface in the process of changing to the at least other position.

FIG. 12C is a side representational view of other position of the at least two positions of the cam surface.

DESCRIPTION OF THE PREFERRED EMBODIMENTS

Figure 1:
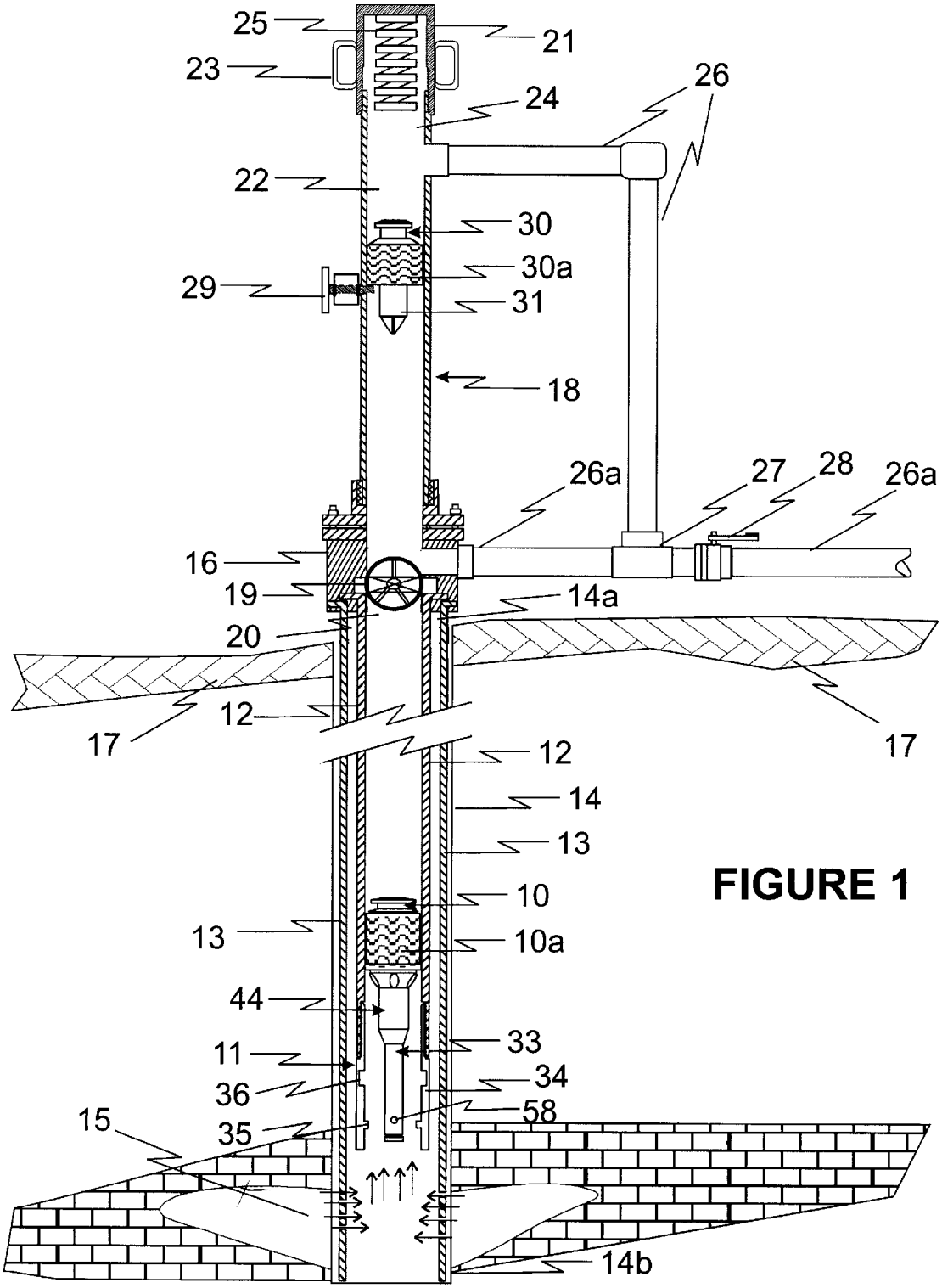
FIG. 1 is a fragmentary and partially cutaway view of an embodiment of the oil field assembly of this invention attached to a well for gathering data about an oil well and or producing a well showing the traveling piston in substantially free downward movement in the tubing string of a well and with a retrieving dart positioned in the landing housing for releasing the traveling piston after it has completed the gathering of data at a predetermined downhole position.

Referring now to the drawings, wherein the showings are for the purposes of illustrating some of the various preferred embodiments for this invention and only for illustrating preferred embodiments of the invention, and not for the purposes of limiting same, FIG. 1 shows generally one embodiment of the oil field assembly having the self regulating and substantially free traveling piston 10 moving downward by gravity toward a predetermined landing receiving location 11 in a tubing string 12 which is located in an oil well casing 13 set inside a well 14. It will be understood by those skilled in the oil well art that the landing receiving location 11 will be located generally at or near the bottom of the well 14B in or close to a production zone 15. Also as those skilled in the oil well art will recognize the tubing string 12 and well casing 13 will be hung or set in a wellhead 16 generally located on the surface of the ground 17 at the top of the well 14A. In this embodiment of the oil field assembly a landing housing 18 is connected in fluid communication with the tubing string 12 in such a manner as to not interfere with the wells production and to allow the traveling piston 10 to be completely driven into the landing housing 18 upon operation of this oil field assembly. Also shown in FIG. 1 is a dart member 30 which is located, at this particular point in the operational cycle, in the landing housing 18.

The landing housing 18 may be mounted onto the wellhead 16 in such a manner as to allow the traveling piston 10 to pass into the landing housing 18. A valve 19 is positioned at the bottom end 20 of the wellhead to close off the landing housing 18 and the main flow line 26A from the tubing string 12. At the end 24 of the landing housing 18 away from the valve 19 is located a screw on cap 21 which may be removed to obtain access to the chamber 22 of the landing housing 18. This easy access to the chamber 22 of the landing housing 18, to add parts like the dart member 30 and the traveling piston 10 when needed and then reseal the landing housing 18 by screwing the cap 21 back on, makes the ability to work with this oil field assembly very quick and easy for the operators. This cap 21 also has, at least in this embodiment, a pair of gripping handles 23 to assist in screwing and unscrewing the cap 21 off the end 24 of the landing housing 18. Also provided in the cap 21 is a coil spring 25 for absorbing the force of the traveling piston 10 upon its entry into the chamber 22 of the landing housing 18 should it arrive with some excessive force from the tubing string 12. Also connected in fluid communication with the chamber 22 is a flow line 26 which receives the fluids of the tubing string 12, which may be pushed ahead of the traveling piston 10 upon its entrance into the chamber 22 of the landing housing 18. It would be understood by those skilled in the art that unless the fluids being pushed ahead of the traveling piston 10 are removed a back pressure may develop and the traveling piston 10 may hang at the valve 19 or not be able to fully travel into the chamber 22 of the landing housing 18. In this embodiment the flow line 26 is attached more closely to the end 24 of the landing housing 18 so that the travelling piston 10 could come all the way into the chamber 22 of the landing housing 18 but have a portion of the chamber 22 of the landing housing 18 available to create a back pressure from the fluids being pushed ahead of the traveling piston 10 which may act as a damper to the speed of the returning traveling piston 10. The flow line 26 as shown in FIG. 1 is reconnected to the main flow line 26A at a junction tee 27 for its return to the well fluids being taken from the well. A control valve 28 is provided down stream of the junction tee 27 to control the fluid flow of the well from the tubing string 12. Those skilled in the well art will appreciate that by controlling the flow of the well fluids up the tubing string 12 one may provide some assisted control of the rate of speed of ascent and/or descent of the traveling piston 10 by controlling the rate of fluid movement up the tubing string 12.

Also operationally connected to the landing housing 18 is a releasable securing member 29 which is projected through the wall of or retracted through the wall of the landing housing 18 for providing a way to retain the traveling piston 10 or other tools, such as the dart member 30, used with the traveling piston 10 in the landing housing 18 for their controlled release into the tubing string 12 as desired. One of the benefits of being able to releasable secure the traveling piston 10 is to facilitate the retrieval of the traveling piston 10 from the landing housing 18. The removal of the traveling piston 10 from the landing housing can be for the purpose of downloading the data accumulated by the instrument section 33 by connecting the instrumentation 33 to a portable computer not shown in FIG. 1. Another benefit of being able to releasable secure the traveling piston 10 is to bring a portable computer, also not shown in FIG. 1, with an inductive data transfer capability near the landing housing 18 with the traveling piston 10 secured by the releasable securing member 29 for inductively down loading the instrument package 33 mounted to the traveling piston 10 and then releasing the traveling piston 10 by retracting the releasable securing member 29 and letting the traveling piston 10 fall back into the well by gravity to gather more data and or produce the well 14 on it next movement from the bottom of the well 14*b* to the surface of the well 14*a*.

The oil field assembly, also as shown in FIG. 1, has provided a landing receiving member 34 located at the predetermined landing receiving location 11 which in at least this embodiment has a "no go" surface 35 provided to prevent the traveling piston 10 from exiting the tubing string 12 upon it arrival at the bottom of the well 14*b*. Also proximate to the "no go" surface 35 is provided a recess 36 into which the traveling piston 10 can releasable lock itself to allow the traveling piston 10 to stay in the well at this predetermined landing receiving location 11 as long as necessary to gather data about the well while it is at that landing receiving location 11. This releasable locking by the traveling piston 10 is achieved by a releasable spring-loaded locking mechanism 37, shown in FIG. 2, being driven into the recess 36. It will be understood by those skilled in the art that a standard "landing nipple" may be used with the traveling piston 10 providing the design of the "landing nipple" is known to the operator of the oil field assembly of this invention so that he can configure the traveling piston 10 to match the locking mechanism of the traveling piston with the "landing nipple".

Figures 2, 3:
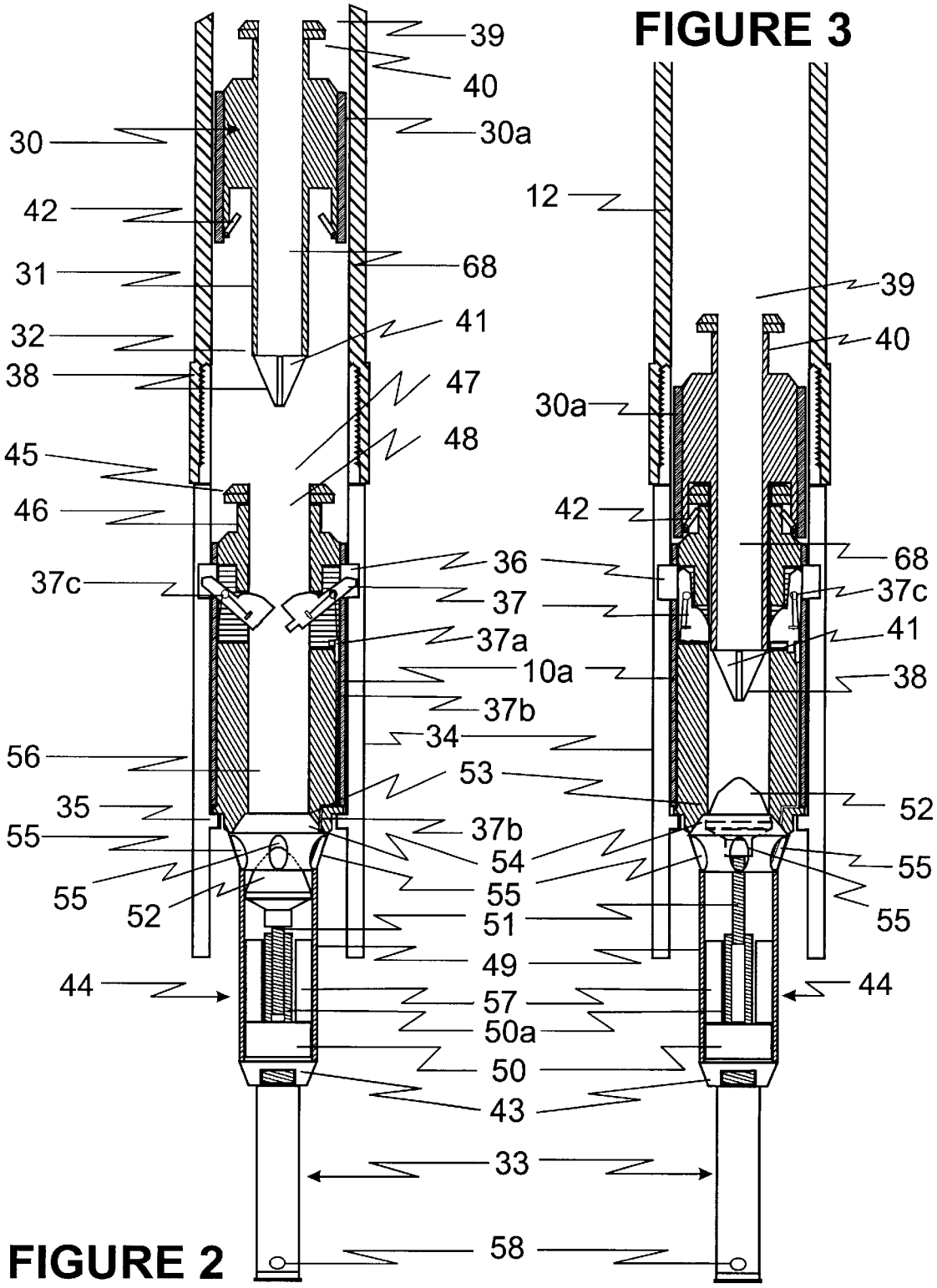
FIG. 2 is a fragmentary and partially cutaway view of the traveling piston in position at a predetermined down hole position and the retrieving dart in free fall and about to couple with the traveling piston and release the traveling piston for return to the surface.
FIG. 3 is a fragmentary and partially cutaway view of the traveling piston in position at a predetermined down hole position and the retrieving dart is coupled with the traveling piston and has release the traveling piston for return to the surface.

The traveling piston 10, of at least one embodiment of the oil field assembly of this invention, as is shown in FIG. 2, is composed of an instrument package 33, which is mounted on the down hole end 43 of the traveling piston 10; and a self regulating section 44 for controlling the speed of descent and ascent of the traveling piston 10; and a releasable spring-loaded locking mechanism 37 for releasable locking the traveling piston 10 into the landing receiving member 34. The up hole portion 45 of the traveling piston 10 is formed with a "fishing neck" 46, which as those skilled in the art will appreciate is a standard configuration to allow the traveling piston 10 to be fished out of the tubing string 12 should it get stuck in the tubing string 12. However the center section 47 of the up hole portion 45 about which the "fishing neck" 46 is formed has a female receiving member 48 therethrough to allow well fluids to freely flow and for receiving additional tools such as a dart member 30 therein. In the case of receiving the dart member 30 the releasable locking mechanism 37 on the traveling piston 10 is releasable unlocked from the landing receiving member 11 upon the male portion 31 of the dart member 30 being inserted. The insertion of the dart member 30 cause the releasable locking mechanism 37 to rotate about pivot pin 37*c* and retract, such that the traveling piston 10 and the dart member 30 can be returned to the landing housing 18 on the surface at the top of the well 14*a*. FIG. 2 shows the traveling piston 10 just before the striking of the dart member 30 with its male portion 31 a into the female receiving member 48 of the up hole portion 45 of the traveling piston 10. FIG. 3 show the traveling piston 10 and the dart member 30 mated and released and ready for return to the surface at the top of the well 14*a*.

The self regulating section 44 of the traveling piston 10, at least in the embodiment of FIGS. 2 & 3 is composed of a motor housing 49 with an electric motor 50 therein and a motor shaft 50*a* connected to the electric motor 50. Connected to the motor shaft 50*a* is a valve stem 51 which can be driven in and out by the motor shaft 50*a* being rotated respectively clockwise and counterclockwise by the electric motor 50. Connected to the valve stem 51 away from the electric motor 50 is mounted a valve seat 52 which may by the action of the electric motor 50 be moved into engagement with a valve seating surface 53 or fully away therefrom. The up hole end 54 of the motor housing 49 has a series of apertures 55 therein for allowing fluid flow therethrough and into a central channel 56 of the traveling piston 10 which central channel 56 connects with the female receiving member 45 to allow free fluid flow into and out of the series of apertures 55 and the female receiving member 48. This free flow allows the fluid pressure to be equalized above and below the traveling piston 10 when the valve seat 52 and seating surface 53 are moved fully away from each other and substantially no differential pressure is created between the pressures above or below the traveling piston 10. However if the electric motor 50 is actuated and the valve stem 51 moves the valve seat 52 into engagement with the valve seating surface 53, then differential pressure will be created between the pressures above and below the traveling piston 10. In this embodiment a wire brush outer layer 10*a* covers the upper part of the traveling piston 10 to insure a better seal between the travelling piston 10 and the inside wall of the tubing string 12. This improved seal increases the potential differential pressure which may be obtainable between the downhole end 43 and the uphole end 45 of the travelling piston 10. A wire brush outer layer 30*a* is also present on upper portion of the dart member 30. The improved seal maximize the amount of fluids that the travlling piston 10 can produce to the top of the well 14*a*. It will be appreciated, by those skilled in the well art, that when those differential pressures are sufficiently great the traveling piston 10 will be moved by that differential pressure. In the case of an oil and/or gas well that general direction of movement is from the bottom of the well 14*b* to the top of the well 14*a* because a well produces fluids generally at elevated pressures and once the valve seat 52 and seating surface 53 are engaged the differential pressure on the travel piston 10 would begin to build to drive it to the surface.

Figures 4, 5:
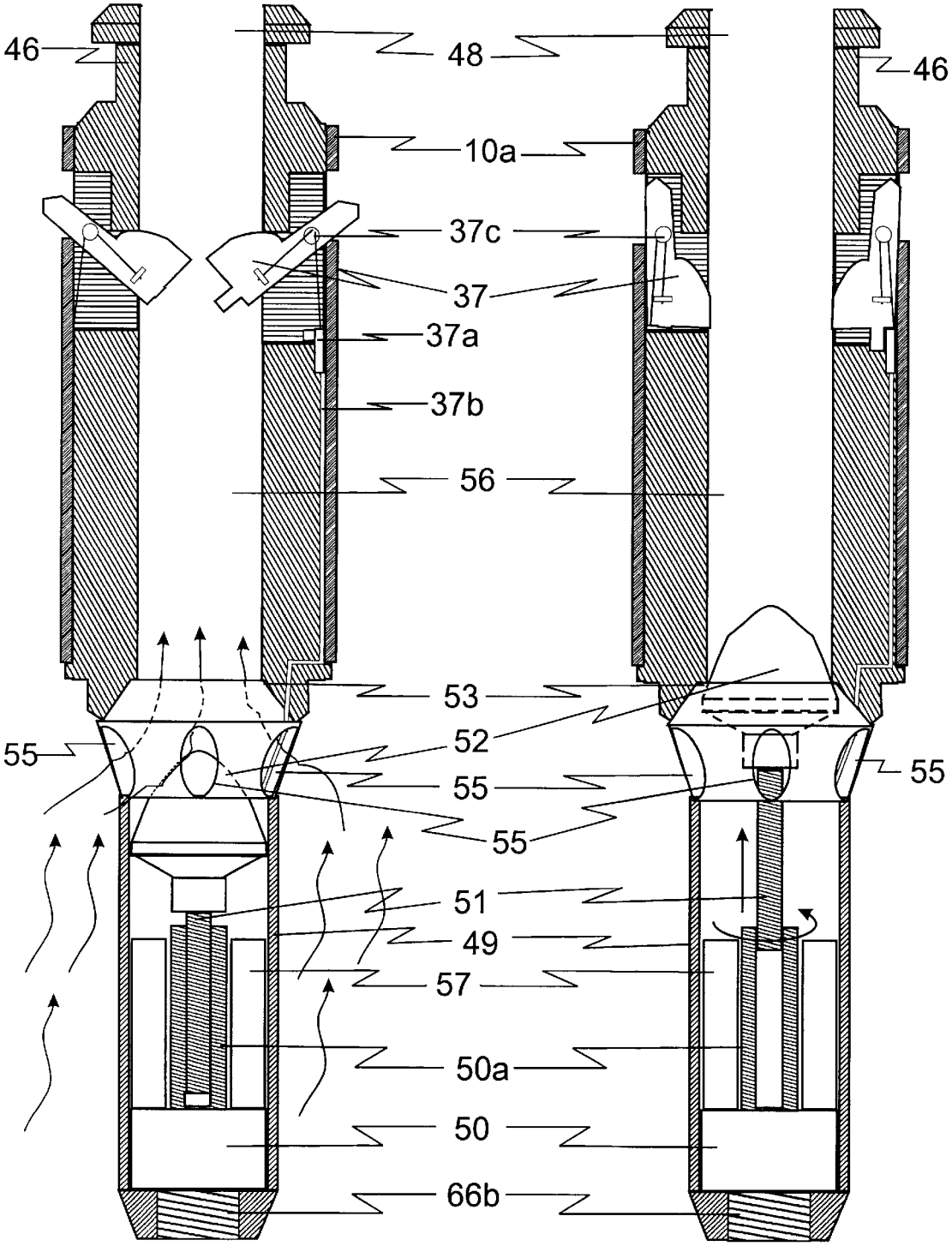
FIG. 4 is a representational and partially cutaway view of the self-regulating motor valve ssembly in the opened position located at the bottom end of the traveling piston.
FIG. 5 is a representational and partially cutaway view of the self-regulating motor valve assembly in the closed position located at the bottom end of the traveling piston.

In FIGS. 4 and 5 the relationship of the apertures 55, the central channel 56 through the traveling piston 10, and the female receiving member 48 can be clearly seen. In FIG. 4 the valve seat 52 and seating surface 53 are fully apart. In FIG. 5 the valve seat 52 and seating surface 53 are fully engaged. The valve stem 51 is threaded on the outside to match the thread on the inside of the motor shaft 50*a* effectively creating a worm gear type engagement. The valve stem 51 through the rotations of the motor shaft 50*a* by the electric motor 50 is controlled by the instruments on the instrument package 33 depending on the speed of ascent and descent in the tubing string 12 as well as the signal from microswitch 37*a*. The motor 50 is powered by a battery pack 57 and controlled in response to some of the instruments in the instrument package 33.

Figure 6:
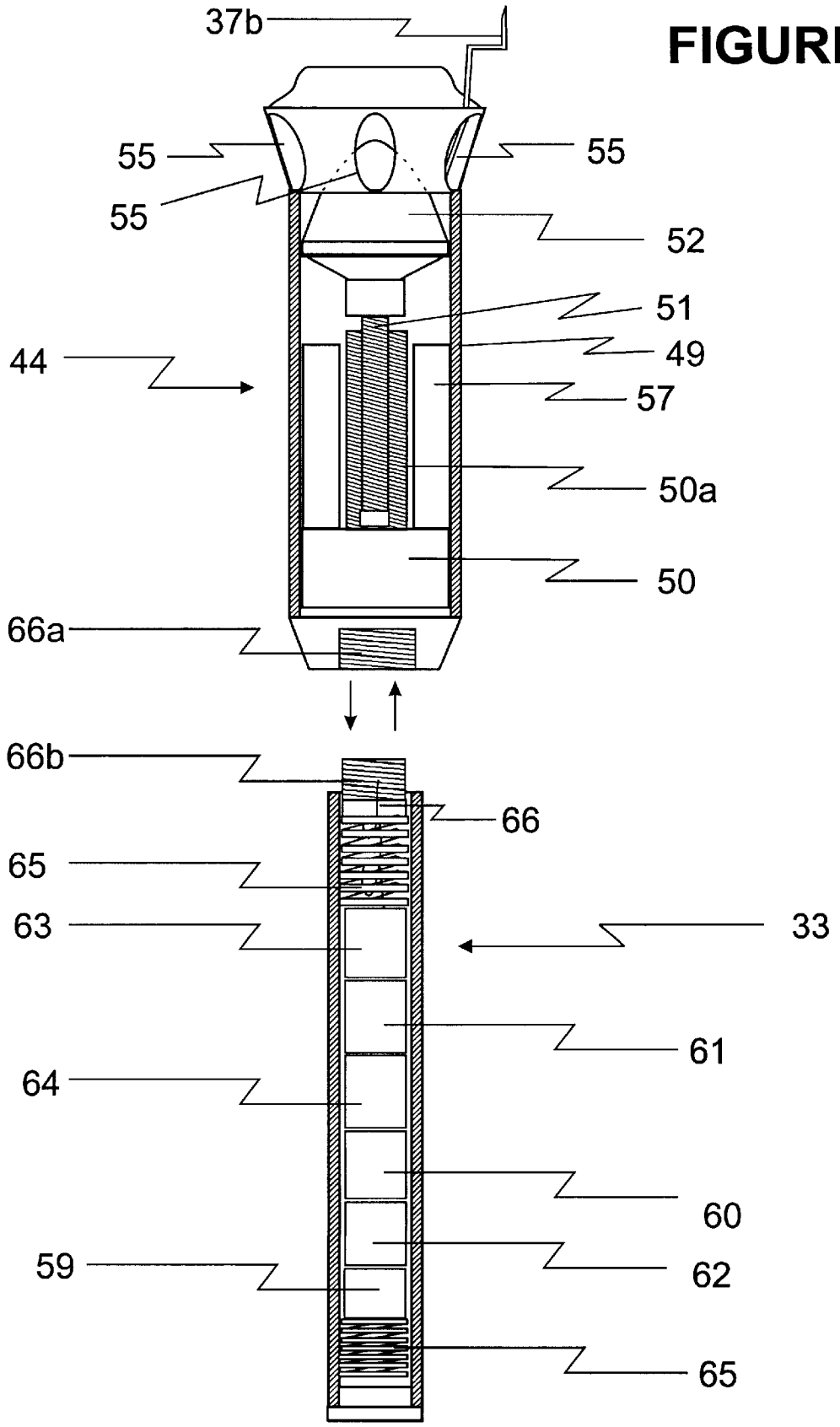
FIG. 6 is a representational and partially cutaway view of the self-regulating means which is part of the traveling piston and the instrumentation means connected thereto for gathering data about the well.
Figure 7:
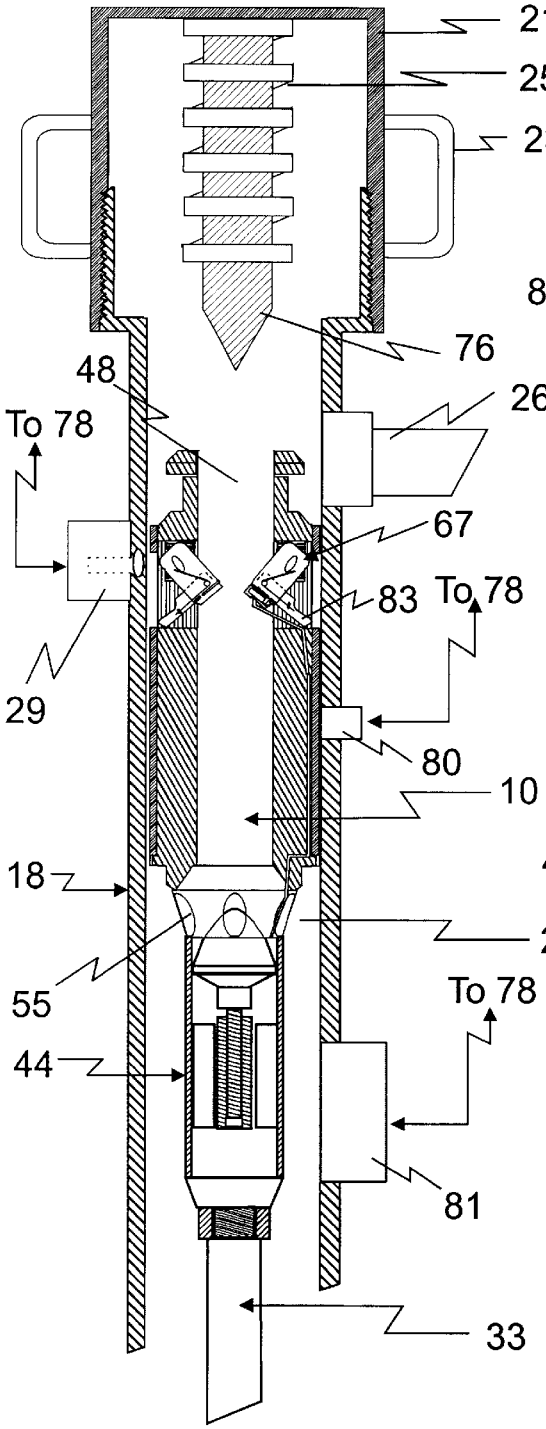
FIG. 7 is a cross sectional view of one embodiment of the releasable latching member on the traveling piston in it's ascent position with the travelling piston going upward inside the surface landing housing just before it strikes the reset bayonet and is captured by the releasable secure member.

The embodiment of FIG. 6 shows by example how the instrumentation and computer components of the instrument package 33 may be mounted. The instrument package 33 is fastened to the travelling piston 10 by a male threaded connector 67 which also provides an electrical connection between instrument package 33 and travelling piston 10. The male threaded connector 66*b* screws into the female threaded connector 66*a* located on the bottom of the travelling piston 10. Both the female threaded connector 66*a* and male threaded connector 66*b* can act as electrical connectors to carry data signal and power between the instrument package 33 and the travelling piston 10. For example in this particular embodiment the power needed to power up the instrumentation package 33 various components is supplied by the battery pack 57 located in the self regulating section 44. The power is sent through the female threaded connector 66*a* on to the male threaded connector 66*b* on to wiring 66. A data signal such as the one generated by microswitch 37*a* is sent on connector cable 37*b* to the female threaded connector 66*a* and on to the male threaded connector 66*b* and on to wiring 66 which will route it to the input/output board 63 for distribution to the central processor 61 which would analyze it and send a response signal for example to the motor controller 64 who in turn would send a signal to electric motor 50. One skilled in the art of well art electronics will appreciate that there are many ways the components in instrument package 33 can be laid out and also many combinations of possible signals and power transfer between the components of this invention. The layout of the components as shown in FIG. 6 and explained below is diagrammatic. Generally there is a port 58 which is open to the tubing string 12, as best seen in FIG. 1, for exposing the sensors 59 of the instrument package 33 to well fluids. Then mounted to the sensors 59, it will also be provided a memory bank 60 to store the data that the sensors 59 sense about the well, such as temperature, pressure, time, depth, time, etc.. Also mounted in the instrument package 33 is an accelerometer 62 which is connected to the central Processor 61 and an input/output interface 63. A motor controller 64 is connected by wiring 66 between the input/output interface and the electric motor 50 to cause the motor to be activated in response to the reading of the accelerometer 62. In some embodiments a shock absorber spring 65 will be mounted between the instrument package 33 and the male threaded connector 66*b* as well as below the sensors or anywhere else within the instrumentation package 33 to cushion the instruments against any excessive forces they might receive on landing either down hole or up hole. It will be understood that various instrument packages could be added to the instruments which have been set out above with out departing from the invention and that it would be the designers choice as to what data is desired and what instruments should be used to obtain the desired data.

In at least one embodiment, as shown in FIG. 1, the dart member 30 is a tool which is used in conjunction with the traveling piston 10 to assist the traveling piston 10 in its return to the surface by releasing the traveling piston 10 from a predetermined landing receiving location 11 in a well. The dart member 30 can be seen in FIGS. 1, 2 & 3. In FIG. 1 the dart member 30 is shown retained in the landing housing 18 prior to release into the tubing string 12. In FIG. 2 the dart member 30 is shown about to be inserted into the traveling piston 10 by gravitational free fall where the travelling piston 10 is releasable latched at a predetermined landing receiving location 11. The dart member 30 as shown in FIG. 2 has a male portion 31 on the down hole end 32 of the dart member 30 for insertion into the traveling piston 10 and for striking and releasing the releasable locking mechanism 37 by retracting the spring loaded locking mechanism 37 on the traveling piston 10. The dart member 30 also is configured to have a self centering surface 38 to guide the male portion 31 of the dart member 30 into engagement with the traveling piston 10. It should also be pointed out that the dart member 30 has apertures 41 spaced on the self centering surfaces 38 and a channel 68 there through for allowing well fluids to freely flow there through. The up hole portion 39 of the dart member 30 is configured with a "fishing neck" 40, which as those skilled in the art will appreciate is a standard configuration to allow the dart member 30 to be fished ut of the tubing string 12 should it stick in the tubing string 12 in a unwanted location. The dart ember 30 through its apertures 41 and channel 68 is open to fluid flow from below and above it so that the dart member 30 does not have any substantial differential pressure acting on it while in the tubing string 12. Further the dart member 30 has connect to it a releasable locking mechanism 42 for releasable locking to the traveling piston 10 once it strikes the raveling piston 10 for connected movement with the traveling piston 10.

In one embodiment as shown in FIGS. 1, 2, and 3 the traveling piston 10 would be released into the tubing string 12 at the top of the well 14a and allowed to freely descend by gravity in the well to a predetermined landing receiving location 11 in the well. The speed of descent would be controlled by the instrument package 33 reading the acceleration from the accelerometer 62 and/or other sensors 59 readings such as, for example, magnetic flux in conjunction with time data from the central processor 61 internal clock and adjusting the differential pressure above and below the traveling piston 10 by automatically controlling the opening between the valve seat 52 and the valve seating surface 53. Thus if the traveling piston 10 was accelerating at too high a speed the accelerometer 62 would signal the central processor 61 and the central processor through the input/output interface 63 would instruct the motor controller 64 to actuate the electric motor 50 to advance the valve stem 51 and valve seat 52 toward the valve seating surface 53 an amount sufficient to adjust the differential pressure and reduce the speed of the traveling piston 10 so that on coming to the bottom of the well at the predetermined landing receiving location 11 no damage will occur to the instruments mounted in the instrument package 33 from excessive impact forces. Once at the predetermined landing receiving location 11 the no-go surface 35 insures that the traveling piston 10 does not fall off the bottom of the tubing string 12 and the releasable locking mechanism 37 is forced into the recess 36 to secure the traveling piston 10 in the tubing string 12 to allow the instrument package 33 to collect data about the well. In the embodiment of FIG. 1, after the traveling piston 10 and instrument package 33 have been left the desired length of time at the predetermined landing receiving location 11 at the well bottom 14*b*, the dart member 30 would be dropped into the tubing string 12 by releasing it from the landing housing 18 with the releasable securing member 29. The dart member 30 would travel down the tubing string 12 by gravity and insert it's male portion 31 into the female receiving member 48 of the traveling piston 10. Upon the insertion of the male portion 31 the spring-loaded releasable locking mechanism 37 would be retracted. When retracting the spring-loaded releasable locking mechanism 37 it would strike the microswitch 37*a* which would send a signal to the motor controller 64 via connector cable 37*b*. The motor controller 64 would in turn send a signal to the electric motor 50 to advance the valve stem 51 and the valve seat 52 toward the valve seating surface 53 an amount sufficient to raise the differential pressure an amount sufficient to cause the traveling piston 10 to start movement toward the surface. Once traveling piston 10 is activated and starts movement up the tubing string 12, the accelerometer 62 and/or other sensors 59 such as, for example, a magnetic flux detector, the central processor 61 the input/output interface 63 and the motor controller 64 would be active to control the rate of speed of the returning traveling piston 10 by controlling the differential pressure above and below the traveling piston 10. Those skilled in the art will appreciate that pressure changes may and do occur all along the tubing string 12 and that the adjusting process discussed above will be occurring all during the travel of the traveling piston 10 until it reaches the landing housing 18 safely at a controlled rate of speed which will not damage the instrument package 33 on the traveling piston 10. Once in the landing housing 18 the valve 19 would be closed and the releasable securing member 29 would be engaged to secure the traveling piston 10 in the chamber 22 of the landing housing 18. Once secured the traveling piston 10 may be either removed by taking the screw cap 21 off and the traveling piston 10 out of the chamber 22 for connection of a computer to the memory bank 60 of the instrument package 33 to download the well data collected by the instrument package while it was in the well. Also in some embodiments an inductive means of downloading the data about the well may occur through the wall of the chamber 22 without removing the traveling piston 10 and its instrument package 33 from the chamber 22. Once the well data has been downloaded the travelig piston 10 can be reinserted into the tubing string 12 to run the cycle again, if desired.

Figure 13:
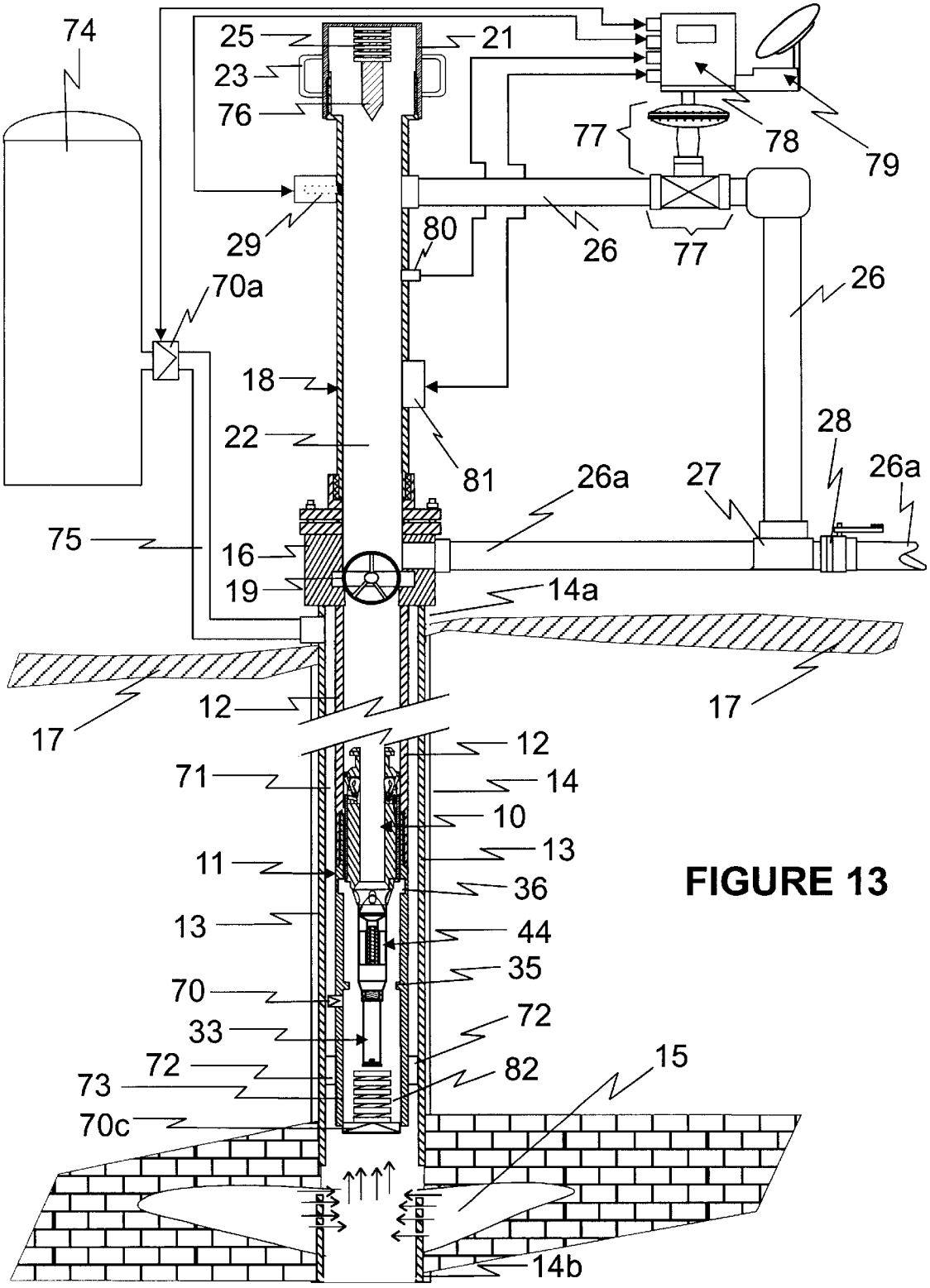
FIG. 13 is a fragmentary and partially cutaway view of a the oil field assembly of this invention attached to a well for gathering data about an oil well and or producing a well showing the traveling piston in substantially free movement in the tubing string of a well and with a high pressure source connected to the annulus of the well for injecting high pressure fluid through a valve located at a predetermined position in the tubing string for driving the traveling piston up hole with the up hole equipment including the telemetering and automatic controls for automatic control of the assembly.

In yet another embodiment of the self regulating and substantially freely moving traveling piston 10 of the oil field assembly for gathering data about a well and/or for producing a well, as shown in FIG. 13 the traveling piston 10 is designed to be operated in a fully automated oil field assembly which can be controlled remotely. In this embodiment the traveling piston 10 can collect the data simultaneously with the production of the well.

The embodiment shown in FIG. 13 shows the self regulating and substantially free traveling piston 10 moving downward by gravity toward a predetermined landing receiving location 11 in a tubing string 12 which is located in an oil well casing 13. In this embodiment the last section 73 of the tubing string 12 has been provided with a unidirectional flow valve 70 which allows flow from the annulus 71 created between the tubing string 12 and the well casing 13 into the tubing string 12. A packer 72 has been set in the last section 73 of the tubing string 12 to seal the annulus 71 from the well fluids and to make the annulus 71 a continuous chamber from the top of the well 14*a* down to a point below the unidirectional flow valve 70. Like other embodiments it will be understood by those skilled in the oil well arts that the landing receiving location 11 will be located generally at or near the bottom of the well 14*b* in or close to a production zone 15. Also as those skilled in the oil well art will recognize the tubing string 12 and well casing 13 will be hung or set in a wellhead 16 generally located on the surface of the ground 17 at the top of the well 14*a*. As in other embodiments of the oil field assembly a landing housing 18 is connected in fluid communication with the tubing string 12 in such a manner as to not interfere with the wells production and to allow the traveling piston 10 to be completely driven into the landing housing 18 upon operation of this oil field assembly. However in this embodiment a high-pressure fluid tank 74 is connected in fluid communication by a line 75 and a unidirectional flow valve 70*a*, connected to computer 78, through the well casing 13 to the annulus 71. As previously pointed out above the annulus is a sealed system from the top of the well 14*a* down to the packer 72 and thus the high pressure fluid from the high pressure fluid tank 74 can be transmitted from the high pressure fluid tank 74 to the unidirectional flow valve 70*a* and on to unidirectional flow valve 70, which as will be explained later can be used to drive the traveling piston 10 from the predetermined landing receiving location up to the top of the well 14*a*. Connected to the bottom of last section 73 is another unidirectional valve 70*c* that would let the fluids from the well in the tubing string 12 but would not let high pressure gas escape in casing 13 below where packer 72 is set, in or close to reservoir zone 15.

The landing housing 18 in this embodiment is mounted onto the wellhead 16 in such a manner as to allow the traveling piston 10 to pass into the landing housing 18. A valve 19 is positioned at the bottom end 20 of the wellhead 16 to close off the landing housing 18 from the tubing string 12 and the pressures and fluids of the well. A screw-on cap 21 is also located at the top of the landing housing 18 away from the valve 19 to allow the chamber 22 of the landing housing 18 to be accessed and resealed, as needed. The screw-on cap 21 is also provided with at least a pair of gripping handles 23 to assist in screwing and unscrewing the cap 21 off the end 24 of the landing housing 18. The screw-on cap 21 also has mounted in it a coil spring 25 for absorbing the force of the traveling piston 10 upon its entry into the chamber 22 of the landing housing 18 should it arrive with excessive force from the tubing string 12. In this embodiment of the screw-on cap 21 is mounted a reset bayonet 76. Further the screw-on cap 21 of this embodiment is sized to be slightly larger than the tubing string 12 to allow the releasable locking mechanism 67 with its spring loaded projection 83 of the traveling piston 10 to open when the traveling piston 10 with its female receiving member48 is driven on to the reset bayonet 76. In the process of being driven on the reset bayonet 76 the releasable locking mechanism 67 is reset to allow it to reenter the tubing string 12 and then be in position to again open in the recess of a "landing nipple" or a predetermined landing receiving location 11 at the bottom of the well 14*b*. Also connected in fluid communication with the chamber 22 is a flow line 26 which receives the fluids of the tubing string 12 and are returned to the main flow line 26 at a junction tee 27. In this embodiment an automated control valve 77 is provided and the automated control valve 77 is connected to computer 78 mounted at the well. The computer 78 is in turn connected to a telemetering transmission device 79 for transmission and receipt of operational data to control, among other devices, the automated control valve 77. As those skilled in the well arts will appreciate by controlling the flow of the well fluids up the tubing string 12 one may provide some assisted control of the rate of speed of the traveling piston 10 and when it may or may not come up the tubing string 12.

Further in this embodiment a sensor 80 is mounted to the landing housing 18 to sense the presence of the traveling piston 10 when it is returned to the chamber 22 and when it is out of the chamber 22. The sensor 80 is connected to the computer 78. The computer 78 is in turn connected to the telemetering device 79 for transmitting data and receiving instructions for remote monitoring and controlling, if desired, of this assembly. In concert with the sensor 80 output data about the presence or absence of the traveling piston 10 is mounted to the chamber 22 a releasable securing member 29 which is also connected to the computer 78 for securing the traveling piston 10 when present in the chamber 22 and releasing the traveling piston 10 when signaled by the computer 78 to do so in the automated operation of this oil field assembly's operation.

Also in this embodiment an inductive down loading member 81 is mounted to the chamber 22 in a position to allow the instrument package 33 of the traveling piston 10 to be downloaded while it is secured by the releasable securing member 29. The downloaded data is then sent to the computer 78 and on to the telemetering transmission device 79. After the downloading of the data the instrument package 33 of the traveling piston 10 is cleared and readied for return into the tubing string 12 to collect additional data or receive special instructions on how it is to operate while down in the well. Thus after the instrument package 33 is fully instructed the computer would instruct the releasable securing member 29 to release the traveling piston 10 for reinsertion by free fall with gravity back into the well.

Upon being reinserted back into the well, traveling piston 10 will travel to the landing receiving location 11 at the bottom of the well 14*b,* which as in other embodiments has a "no go" surface 35 provided to prevent the traveling piston 10 from exiting the tubing string 12 upon its arrival at the bottom of the well. In this embodiment there is also provided proximate the "no go" surface 35 a recess 36 into which the traveling piston 10 can releasable lock itself to allow the traveling piston 10 to say in the well at this predetermined landing receiving location 11 as long as necessary to gather data about the well and or to produce the well at the appropriate time when the conditions are sensed to be right for the well's production. It will also be understood by those skilled in the art that a standard "landing nipple" may be used with the traveling piston 10 providing the design of the "landing nipple" is known to the operator of the oil field assembly of this invention so that he can configure the traveling piston 10 to match the locking mechanism of the traveling piston with the "landing nipple". In this embodiment the predetermined landing receiving location 11 is provided with a coiled spring 82 to provide energy adsorption upon the traveling piston 10 landing and to assist in protecting the instrument package 33 carried by the traveling piston 10.

In this embodiment, as those skilled in the art will appreciate, some other embodiments may be used, to assist the production of the well fluids by using simultaneously and conjointly the "plunger abilities" of the travelling piston 10 and the "smarts" of the instrumentation package 33. If a sufficient column of well fluids has accumulated above the traveling piston 10, as detected by the sensors in the instrument package 33 and the well has sufficient pressure build up to produce to surface this column of fluids, again as detected by the sensors in the instrument package 33 then the central processor, following its pre-loaded set of instructions, would send a signal to the motor controller 64 to activate the electric motor 50 to advance the valve stem 51 and valve seat 52 against the valve seating surface 53 such that a greater pressure will start to build below than above the traveling piston 10. If this well had insufficient pressure to produce itself once a column of well fluids have accumulated above the traveling piston 10 then the high pressure fluid tank will be opened by the computer 78 and a high pressure fluids would be injected into the annulus and through the unidirectional flow valve 70 to provide sufficient pressure to cause the seating of the valve seat 52 against the valve seating surface 53 in the same manner as set out above about a well having sufficient pressure to produce itself. In either case as set out above, the differential pressure begins to build and put pressure on the releasable cam-mounted locking mechanism 67 of this embodiment.

Figure 8:
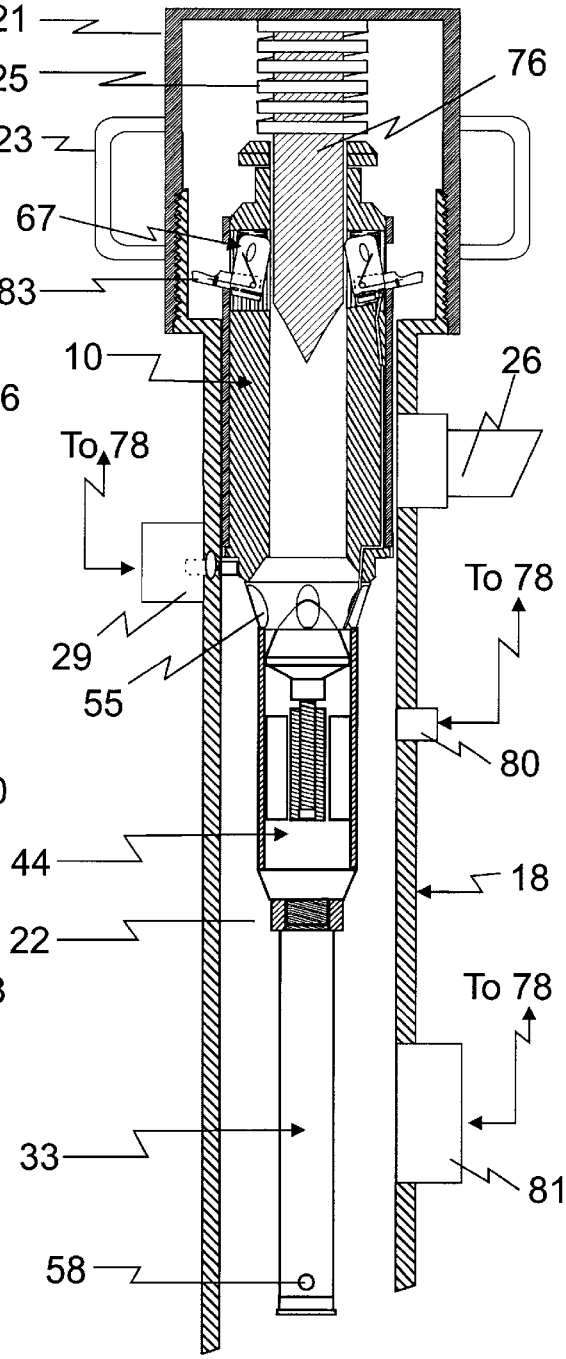
FIG. 8 is a cross sectional view of one embodiment of the releasable latching member on the traveling piston after being reset by insertion of the bayonet in it's descent position and is prepared for reinsertion into the tubing string at the landing housing.

In this embodiment the releasable locking mechanism 67 is as shown in FIGS. 8, and 9 provided with a break over mechanism which is shown in more detail in FIGS. 10, 11, and 12, 12A,B,C. In FIG. 9 it can be seen that the releasable locking mechanism 67 is made of a main body 90 inside which a pivotally mounted projection 83 mounted for moving about pivot pin 83*a* outwardly and inwardly from the traveling piston 10. In FIG. 9 the pivotally mounted projection 83 is mounted for moving outwardly by a spring member 84 into the recess 36 of the predetermined landing receiving location 11 to releasable lock the traveling piston 10 in place and drive the pivotally mounted projection against a stop 85. In some embodiments the stop 85 is fitted with a microswitch 37*a* which is tripped when the pivotally mounted projection 83 is fully outwardly extended. This micro switch 37*a* then relays, through cable connector cable 37*b,* to the instrument package 33 that the traveling piston 10 is in place and secured for it to do its work while secured. However after the traveling piston 10 and the instrument package 33 have completed their work the valve seat and valve seating surface are closed against each other and the differential pressure above and below the traveling piston 10 begins to build.

In this embodiment the releasable main body 90 of the cam-mounted locking mechanism 67 is connected to an oval axle 86 which is in moving engagement with at least two positioning cam surfaces 88 which are mounted between at least two compression springs 87 for pressing the two positioning cam surfaces 88 together. As the pressure below the traveling piston 10 increases relative to the pressure above travelling piston 10 an upward force is applied to the traveling piston 10. This upward force translates into a downward force to pivotally mounted projection 83 which is being pushed against recess 36. Mounted projection 83 transfers the downward force to stop 85 which is turn transfers it to main body 90 which will in turn transfer it to oval axle 86. Oval axle 86 will in turn apply a rotational force on surfaces 88 which will collapse springs 87 allowing oval axle 86 to be moved to its other cam position, i.e., from cam position 88*a* to 88*b* or vice versa. The end result being that the locking assemblies 67 are moved inward of the travelling piston 10 which is now free for travel to the top of well 14*a*. Once freed for movement the traveling piston 10 of this embodiment will start it's initial ascent upward at a relatively high velocity, but the continuous monitoring of the travelling piston speed by the instrument package 33 and its sending of appropriate controlling signals to the self regulating section 44 adjust the differential pressure above and below the traveling piston 10 by automatically controlling the opening between the valve seat 52 and the valve seating surface 53. Thus if the traveling piston 10 in its initial motion is at too high a speed the accelerometer 62 would signal the central processor 61 and the central processor through the input/output interface 63 would instruct the motor controller 64 to actuate the electric motor 50 to advance the valve stem 51 and valve seat 52 away from the valve seating surface 53 an amount sufficient to adjust the differential pressure and reduce the speed of the traveling piston 10 so that on coming to into the landing housing 18 at the top of the well 14*a* the traveling piston 10 would not land with a force so great as to damage the landing housing 18 or the instrument package 33 on the traveling piston 10. It should be understood however that the aveling piston 10 should land with sufficient force to drive itself into the reset bayonet 76, which would enter the female receiving member 48 of the traveling piston 10 and strike the back side 89 of the main body 90 of the cam-mounted locking mechanism 67, resulting in the main body 90, the pivotally mounted projections 83, and the oval axle 86, moving from one of the at least two positioning cam surface 88*b* to the other 88*a* . Once moved to the position 88*a* the pivotally mounted projection 83 will extend into the additional space in the screw on cap 21 and be in a proper position for reinsertion back into the tubing string thus completing an operating cycle for the oil field assembly for either and or gathering data or producing the well.

Figure 14:
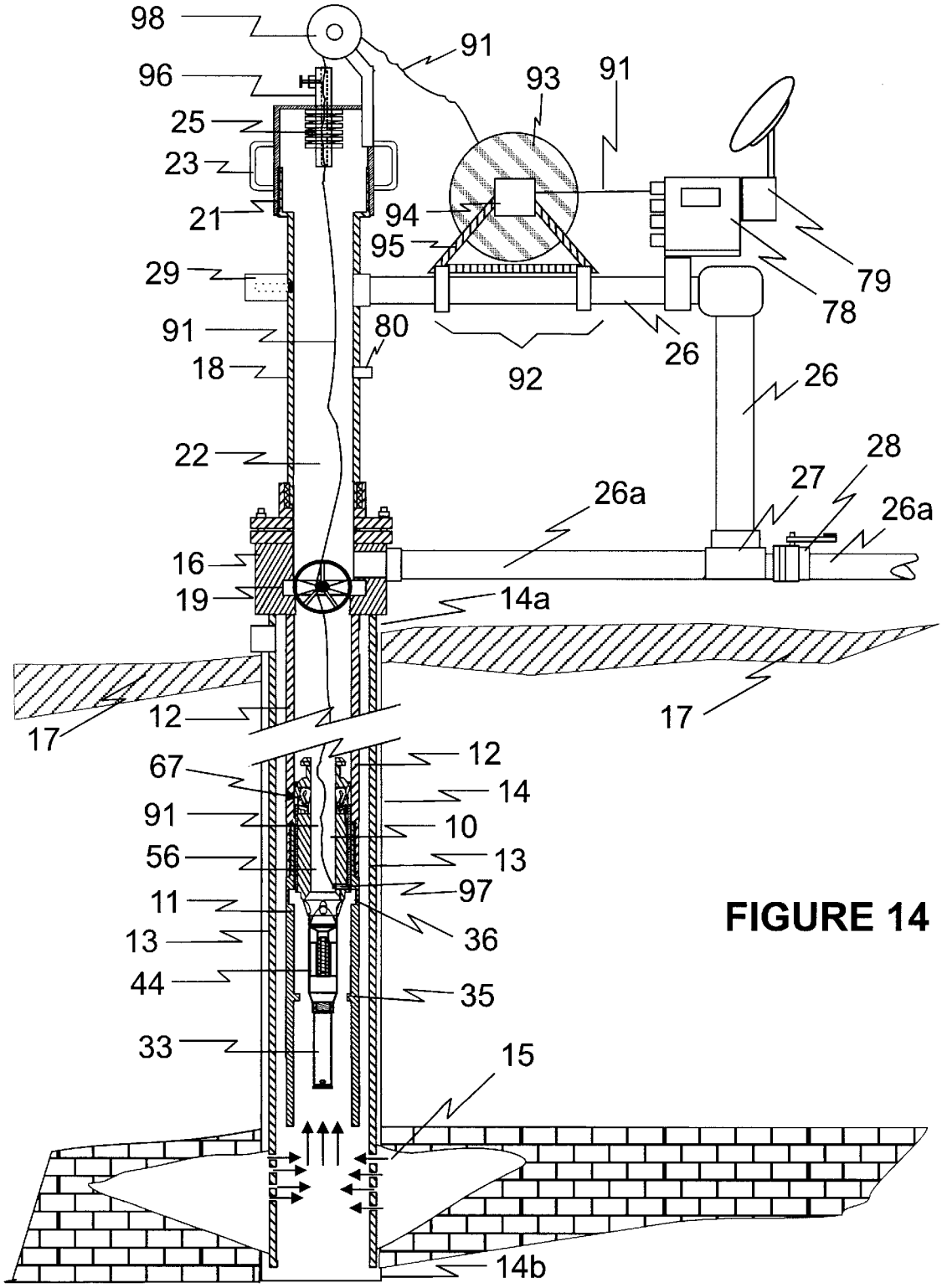
FIG. 14 is a fragmentary and partially cutaway view of a the oil field assembly of this invention attached to a well for gathering data about an oil well and or producing a well showing the traveling piston in substantially free movement in the tubing string of a well and with a non-structural cable attached to it and the uphole equipment including a spooling device, computer and telemetering device.

In this embodiment, depicted in FIG. 14, the travelling piston 10 is connected to a non-structural data cable 91 for its descent to the bottom of well 14*b* giving the assembly of this invention the advantage of real time downhole readings from the sensors 59 of the instrument package 33. Cable 91 is being pulled downward by the gravity free falling travelling piston 10. Since the data cable 91 does not have to hold and/or pull weight other than its own, its size can be kept small and therefore it does not require big heavy wireline type equipment for its deployment. Data cable 91 carries data to and from instrumentation package 33 which is attached to the lower part of the travelling piston 10 but has insufficient strength and size to retrieve the traveling piston 10. The core of cable 91 is any material that will conduct electricity and/or light in the case of optical cable. The outer sheath is any material that will protect the conductor core from the well's fluids and conditions, such as polypropylene.

The data cable 91 is deployed using spooling assembly 92 composed of a reel 93 to house the cable 91, a cradle 95 to support the reel 93 and allow it to turn and a motor 94 to provide the drive to spool cable 91 back onto reel 93. For the descent operation valve 19 is first closed to contain the well fluids while screw-on cap 21 outfitted with a pack-off assembly 96 through its center is taken off the landing housing 18 in order to insert the travelling piston 10 with its instrument package 33 attached therein. The pack-off assembly 96 provides a seal around cable 91 still allowing cable 91 to move up or down the well while maintaining the well's pressure integrity. The data cable 91 is taken from reel 93 placed over sheave 98, fed through the pack-off assembly 96 then through the female receiving member 48 of the travelling piston 10 and connected to terminal 97 mounted on the wall of central channel 56 just above the self regulating means 44. The terminal 97 is connected to the female threaded connector 66*a* at the bottom of the self regulating means 44 which is connected to the male threaded connector 66*b* of the instrument package which is in turn connected to wiring 66 which is connected to input/output board 63. Now the screw-on cap is screwed back on the landing housing and valve 19 is opened giving access to tubing string 12. The releasing securing member 29 is activated in order to release the travelling piston 10 which will start its free descent being pull downward to the bottom of well 14*b* solely by gravity. Cable 91 is left to freely spool off reel 93. The well data detected by sensors 59 is simultaneously stored in memory bank 60 and sent uphole via cable 91 to be stored in computer 78 and/or monitored in real time by an operator on the site and/or sent to a remote location for monitoring or storage using transmission device 79. The travelling piston 10, as in previous embodiments, control its rate of descent using the data acquired by its sensors 59 and/or its accelerometer 62 in conjunction with the central processor 61 and motor controller 64 to instruct motor 50 to move valve stem 51 and attached valve seat 52 appropriately further or closer to valve seat 53. The traveling piston 10 will travel to the landing receiving location 11 at the bottom of the well 14*b*, which as in other embodiments has a "no go" surface 35 provided to prevent the traveling piston 10 from exiting the tubing string 12 upon its arrival at the bottom of the well. In this embodiment there is also provided proximate to the "no go" surface 35 a recess 36 into which the traveling piston 10 can releasable lock itself using cam-mounted locking mechanism 67 to allow the traveling piston 10 to stay in the well at this predetermined landing receiving location 11 as long as necessary to gather data about the well. As in other embodiments the extension of pivotally mounted projections 83 into recess 36 trips microswitch 37*a* which signaled the motor controller to bring valve seat 52 the farthest from valve seating surface 53 letting fluids from the well free to flow through chamber 22 of travelling piston 10 for the duration of the test.

When enough data as been accumulated, using spooling assembly 92, cable 91 is pulled free from the travelling piston and spooled back on to reel 93 so as not to be attached to travelling piston 10 when travelling piston 10 starts its ascent to top of well 14*b*. The disconnection of cable 91 is detected by central processor 61 which send instructions to the motor controller to cause motor 50 to bring valve seat 52 against valve seating surface 53 effectively building up the pressure below the travelling piston 10 and hence applying an upward force to the travelling piston 10 which is transferred to the pivotally mounted projections 83 forcing the cam-mounted locking mechanism 67 in its ascent position hence freeing the travelling piston 10 to move upward to the top of well 14*a*. As with previous embodiment travelling piston speed will be monitored and controlled by the conjoint actions of instrument package 33 and self regulating means 44. Once in the landing housing the travelling piston 10 is captured by the releasable securing member 29 and the cam-mounted locking mechanism is reset in its descent position when striking the bottom of pack-off device 96 which acts as the reset bayonet 76 in this embodiment. The travelling piston 10 is ready to be retrieved from the landing housing or resent for another data gathering cycle with or without cable 91 as desired by the well operator.

Figure 15:
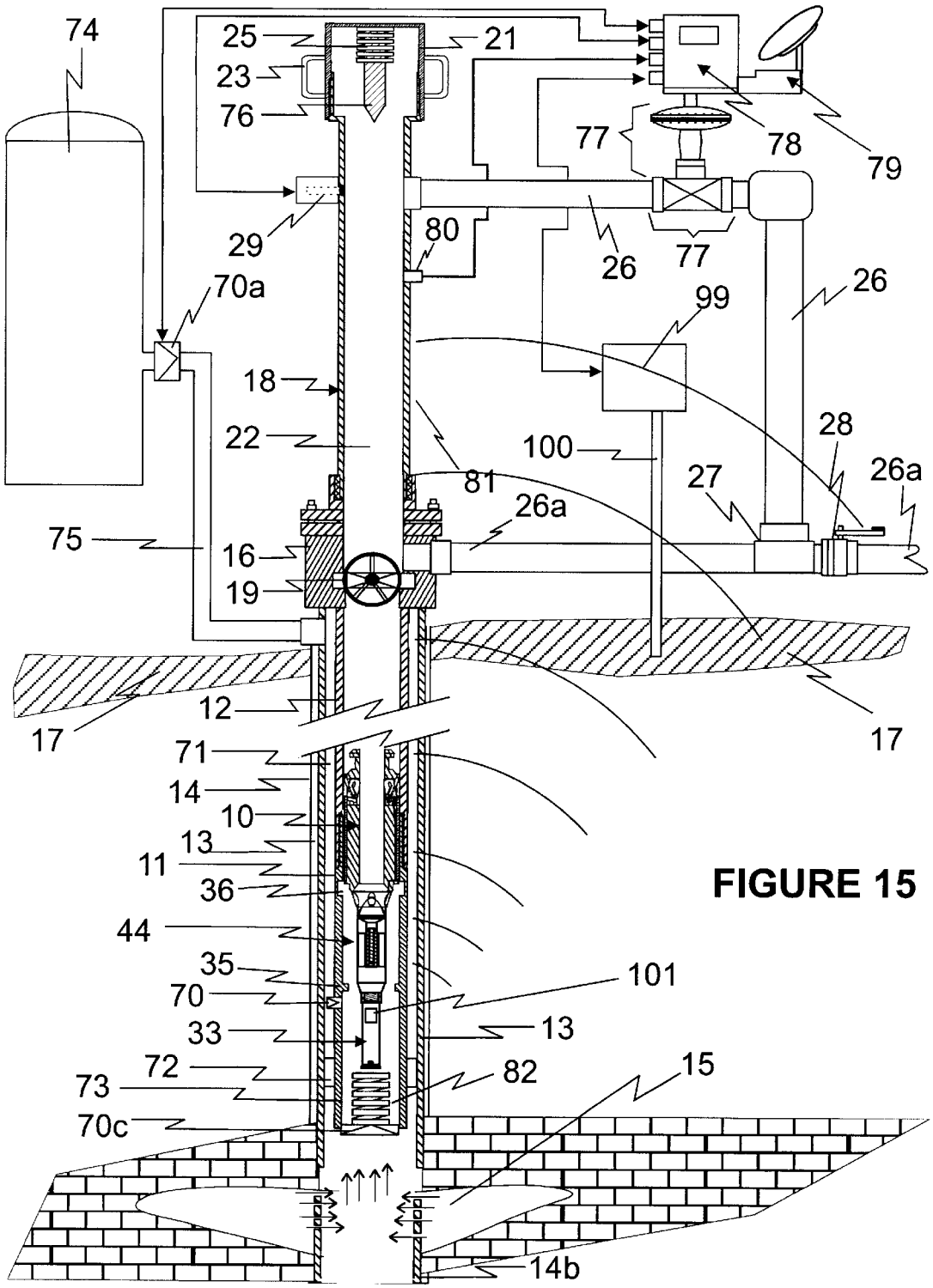
FIG. 15 is a fragmentary and partially cutaway view of a the oil field assembly of this invention attached to a well for gathering data about an oil well and or producing a well showing the traveling piston in substantially free movement in the tubing string of a well and with its instrument section equipped with an electromagnetic telemetry system and the uphole equipment including an electromagnetic telemetry system, a computer and telemetering transmission device.

In the embodiment depicted in FIG. 15 the instrument package 33 is outfitted with an electromagnetic telemetry board 101 which emits and receives low frequency radio waves from a surface electromagnetic telemetry devices 99 which is connected to antenna 100 and computer 78 which is in turn connected to telemetry transmission device 79. Thus in such an embodiment the traveling piston perform as before illustrated in the several embodiment but would be able to communicate in real time as it moves from the top of the well 14a to the bottom of the well 14*b* giving valuable data as it moves and self controls its speed of movement.

The invention has been described with reference to the preferred embodiments. Obviously, modifications and alterations will occur to others upon a reading and understanding of this specification but those alterations are intended to be included in this invention such that all such modifications and alterations insofar as they come with in the scope of the appended claims and equivalents there of.

Having thus described the invention, we claim:

1. An oil field assembly for gathering data from an oil well and producing a well having a portion of said assembly self regulating and substantially free for free movement by gravity or the fluids of the well in a tubing string of the well located in a well casing for movement from or to the surface of the well or from or to predetermined down hole positions and for collecting data while freely moving between said surface of said well and said predetermined down hole positions and for collecting downhole data from said well while said substantially freely movable assembly is at said predetermined downhole positions, and for return to the surface of said well and producing said well upon the return of said assembly comprising;

(a) a traveling piston which is substantially free for free movement solely by gravity or said fluids of the well for movement from or to the surface of the well and from orto predetermined down hole positions for collecting downhole data from said well as said traveling piston moves substantially freely between said surface and predetermined downhole position or positions, (b) instrumentation means connected to said traveling piston for gathering data from said well as said travelling piston moves between said surface of said well and said predetermined downhole position or positions, (c) a landing housing means located at or near the surface of the well for receiving said traveling piston and for controllably releasing said traveling piston into said tubing string of the well, (d) a landing receiving means located at or near the bottom of said tubing string of the well for releasably receiving said traveling piston, and (e) a plurality of instrumentation members located at or near said landing housing means for receiving said data gathered by said instrumentation means on said traveling piston.

2. The oil field assembly for gathering data from an oil well and producing said well as in claim 1 further comprising, a self regulating means connected to said travelling piston for controlling the speed of descent and ascent of said traveling piston in said tubing string of said well to allow the safe landing at said landing receiving means and at said landing housing means and for allowing sufficient time for said instrumentation means connected to said traveling position to gather data from said well between said surface of said well and said predetermined downhole position or positions.

3. The oil field assembly for gathering data from an oil well and producing said well as in claim 2 further comprising, a control means connected to said landing housing means for controlling the pressure and flow rate in the tubing string of said well for operation in conjunction with said self regulating means connected to said traveling piston for controlling the speed of descent and ascent of said traveling piston.

4. The oil field assembly for gathering data from an oil well and producing said well as in claim 3 further comprising, a sensor means connected to said traveling piston for sensing the rate of descent and ascent and connected to said self regulating means for controlling the speed of decent or ascent of said traveling piston in said tubing string of the well under varying differential pressures of well fluid flow conditions to allow the safe landing at said landing receiving means.

5. The oil field assembly for gathering data from an oil well and producing said well as in claim 4 wherein said landing housing means further comprising;

an openable housing means for receiving said traveling piston, an impact absorbing means connected in said openable housing for absorbing the impact force of the up hole velocity of said traveling piston as said traveling piston moves up hole and for preventing damage to said sensor means connected to said traveling piston, a means for releasable securing said traveling piston from free movement back into said tubing string of the well, a valve means for closing off said openable housing from said tubing string of a well and leaving said tubing string in fluid communication with said oil well, and a means for down loading the data gathered about said well while said traveling piston moved between said surface of said well and said predetermined down hole position or positions.

6. The oil field assembly for gathering data from an oil well and producing said well as in claim 5 further comprising;

an additional valve means openablely connected to said openable housing means and in fluid communication with said well for allowing the differential pressure above and below said traveling piston to bring said traveling piston into said housing means and in contact with said means for releasable securing said traveling piston therein.

7. The oil field assembly for gathering data from an oil well and producing said well as in claim 5 further comprising;

sensing means for sensing the presence of said traveling piston in said openable housing means and for transmitting data at said traveling piston's presence;

actuator means connected to said sensing means for receiving the data transmission from said sensing means and for acting thereon and;

clamping means connected inside said openable housing and to said actuator means for receiving the responce from said sensing means and for releasablely clamping or unclamping said traveling piston in said openable housing means in response to the action of said actuator means.

8. The oil field assembly for gathering data from an oil well and producing said well as in claim 4 further comprising; an annulus means formed between said casing and said tubing string located therein, a high pressure fluid source means controllablely connected in fluid communication with said annulus means for controllably injecting high pressure fluids therein, and a valve means located at a predetermined position in said tubing string for allowing one direction fluid flow from said annulus means into said tubing string for pressuring said fluids in said tubing string and for driving said traveling piston up hole and for producing said well.

9. The oil field assembly for gathering data from an oil well and producing said well as in claim 8 further comprising;

an additional valve means openablely connected in fluid communication with said well at said surface of said well for recover of said high pressure fluid for return to said high pressure fluid source means and reuse.

10. The oil field assembly for gathering data from an oil well and producing said well as in claim 8 wherein said valve means located at a predetermined position in said tubing string is located below said landing receiving means located at or near the bottom of said well.

11. The oil field assembly for gathering data from an oil well and producing said well as in claim 3 wherein said self regulating means connected to said traveling piston for sensing and responding to the differential pressures and flow rate of said fluid or lack thereof in said tubing string of said well for controlling the rate of descent or ascent further comprises;

a sensor means connected to said traveling piston for continuously sensing the rate of descent and ascent, and;

a second sensor means connected to said traveling piston for continuously sensing the conditions of the well during ascent, descent and at predetermined downhole position or positions of said well, and an actuator means connected to said sensor means for controlling, in response to said sensor means the speed of descent and ascent of said travelling piston in said tubing string of the well, by adjusting the differential pressures of the fluids of said well and the rate of fluid flow or lack thereof above and below said traveling piston in said tubing string of the well to allow the safe landing at said landing receiving means or at said landing housing means.

12. The oil field assembly for gathering data from an oil well and producing said well as in claim 11 in which said traveling piston further comprises;

a passage means through said traveling piston for allowing controlled fluid flow there through from above or below said traveling piston in said tubing string, and a valve means connected in fluid communication with said passage means for allowing ascent or descent of said traveling piston in said well by controlling the differential pressure above and below said traveling piston by adjusting the rate of fluid flow through said passage means in said traveling piston.

13. The oil field assembly for gathering data from an oil well and producing said well as in claim 11 further comprising;

a releasable locking means connected to said traveling piston for releasably self locking said traveling piston at said predetermined down hole position in said well.

14. The oil field assembly for gathering data from an oil well and producing said well as in claim 13 wherein said landing receiving means located in said well at predetermined location further comprises;

a landing absorbing means located in said tubing string for absorbing the landing forces of said traveling piston upon landing, and for preventing damage to said instrument means, and a releasably latching means positioned proximate said landing absorbing means for releasably latching with said releasable locking means connected to said traveling piston at predetermined locations in said well for temporarily securing said traveling piston in said tubing string.

15. The oil field assembly for gathering data from an oil well and producing said well as in claim 14 wherein said landing absorbing means further comprises;

a spring means to absorb said landing impact of said traveling piston upon landing.

16. The oil fid assembly for gathering data from an oil well and producing said well as in claim 13 wherein said locking means further comprises;

a releasably latching means on said traveling piston for latching and unlatching said traveling piston at said predetermined downhole positions.

17. The oil field assembly for gathering data from an oil well and producing said well as in claim 16 wherein said releasably latching means on said traveling piston for latching and unlatching said traveling piston at said predetermined downhole positions further comprises;

a pivotally mounted projection mounted for moving outwardly and inwardly from said traveling piston, a stop means positioned on said traveling piston for limiting said pivotally mounted outward movement of said projection and for providing a surface against which said pivotally mounted projection being stopped, an axle means connected to said pivotally mounted projection, a cam means connected to said axle means, a spring means connected to said pivotally mounted project for moving said pivotally mounted project outwardly from said traveling piston upon said traveling piston reaching said predetermined downhole position at said landing receiving means, at least two spring means connected to said traveling piston, and at least two positioning cam surface means compressed between said at least two spring means for receiving said cam means and allowing said pivotally mounted projection, and said axle means to be moved from one of said at least two positioning cam surface means to the other upon sufficient force being acted upon said pivotally mounted projection once stopped at said stop means.

18. The oil field assembly for gathering data from an oil well and producing said well as in claim 17 wherein said landing receiving means located at said predetermined downhole position further comprises; a recess means for receiving said pivotally mounted projection when said spring means drives said projection outwardly for releasable locking said traveling piston in place and for providing a surface against which said projection being driven to provide force sufficient to move said cam means connected to said axle means and for moving said cam means from said one of at least two positions to the other for allowing said projection to be driven to a position for passing said recess means for up hole movement.

19. The oil field assembly for gathering data from an oil well and producing said well as in claim 18 wherein said landing housing means located at or near the surface of the well further comprising; a reset means for moving said projection and cam means from said one of at least two positions to the other for allowing said projection to driven to a position for allowing said traveling piston to be moved back into said tubing string and into said well.

20. The oil field assembly for gathering data from an oil well and producing said well as in claim 19 wherein said reset means for moving said projection and cam means from said one of at least two position to the other further comprises; a bayonet means for insertion into said traveling piston as said traveling piston returns to said landing housing means at the surface of said well.

21. The oil field assembly for gathering data from an oil well and producing said well as in claim 11 further comprising;

a dart means having a male portion on the downhole end of said dart means for free fall insertion into said tubing string of the well for striking said releasably locking means on said traveling piston when said traveling piston is at said predetermined downhole position and for releasing said releasable locking means and said traveling piston for free movement, and a releasable locking means connected to said dart means for locking said releasable locking means on said traveling piston for movement with said traveling piston.

22. The oil field assembly for gathering data from an oil well and producing said well as in claim 21 wherein said traveling piston further comprises;

a female receiving means located on the up hole end of said traveling piston and operationally connected to said releasable locking means for receiving said male portion of said dart means when free fall inserted into said tubing string of a well for actuating said releasable locking means and freeing said traveling piston from said predetermined position for travel in said tubing string.

23. The oil field assembly for gathering data from an oil well and producing said well as in claim 11 further comprising;

a computer means for connecting to said traveling piston for downloading data from said sensor means connected to said traveling piston.

24. The oil field assembly for gathering data from an oil well and producing said well as in claim 23 wherein said computer means for connecting to said traveling piston for downloading data from said sensor means connected to said traveling piston is remotely mounted at said landing housing means and remotely downloads said computer means for downloading data from said sensor means connected to said traveling piston.

25. The oil field assembly for gathering data from an oil well and producing said well as in claim 24 wherein said computer means for connecting to said traveling piston for downloading data from said sensor means connected to said traveling piston further comprises a non structural, data cable means connected to said traveling piston and said computer located at or near said landing housing means for receiving said data in real time as said data is gathered by said instrumentation means connected to said traveling piston at said well.

26. The oil geld assembly for gathering data from an oil well and producing said well as in claim 25 wherein said non structural, data cable means for connecting to said traveling piston for downloading data from said sensor means further comprises an optical non-structural, data cable means connected to said traveling piston.

27. The oil field assembly for gathering data from an oil well and producing said well as in claim 25 wherein said non-structural, data cable means for connecting to said traveling piston for downloading data from said sensor means further comprises an electrical non-structural, data cable means connected to said traveling piston.

28. The oil field assembly for gathering data from an oil well and producing said well as in claim 11 further comprising;

electromagnetic telemetry means located at said landing housing means for transmitting and receiving electromagnetic waves from or to said instrumentation means connected to said traveling piston and;

instrument means located on said traveling piston for transmitting and receiving electromagnetic waves from or to said electromagnetic telemetry means located at said landing housing means for communicating there with in real time.

* * * * *